US007131618B2

(12) United States Patent
Berry et al.

(10) Patent No.: US 7,131,618 B2
(45) Date of Patent: Nov. 7, 2006

(54) GAS CYLINDER BASE

(76) Inventors: Steven J. Berry, 481 Solon Rd., Cedar Springs, MI (US) 49319; Marianne E. Berry, 481 Solon Rd., Cedar Springs, MI (US) 49319

( * ) Notice: Subject to any disclaimer, the term of this patent is extended or adjusted under 35 U.S.C. 154(b) by 280 days.

(21) Appl. No.: 10/604,008

(22) Filed: Jun. 20, 2003

(65) Prior Publication Data

US 2004/0016855 A1 Jan. 29, 2004

Related U.S. Application Data

(60) Provisional application No. 60/398,202, filed on Jul. 24, 2002.

(51) Int. Cl.
*A47B 91/00* (2006.01)
*A47G 29/00* (2006.01)
*B65D 19/00* (2006.01)

(52) U.S. Cl. ..... 248/346.05; 248/310; 248/311.2; 248/346.03

(58) Field of Classification Search ..... 248/346.5, 248/311.2, 346.01, 346.03, 346.11, 146, 523, 248/116; 137/390, 264; 220/582, 587
See application file for complete search history.

(56) References Cited

U.S. PATENT DOCUMENTS 1,881,428 A 10/1932 Finch
2,044,192 A * 6/1936 Templin, Jr. ..... 47/40.5
2,489,766 A 11/1949 Ernestus et al.
2,674,147 A * 4/1954 Franklin ..... 84/95.1
2,683,579 A 7/1954 Wallace
2,847,175 A * 8/1958 Farley et al. ..... 47/40.5
2,905,351 A 9/1959 Lerner
2,905,414 A * 9/1959 Zierden ..... 47/40.5
2,978,215 A * 4/1961 Victor et al. ..... 248/115
3,028,702 A 4/1962 St. Cyr
3,042,350 A * 7/1962 Lencioni ..... 47/40.5
3,163,159 A * 12/1964 Buehl et al. ..... 122/17.1
3,272,466 A 9/1966 Sherman
3,735,895 A 5/1973 Roper
3,840,141 A 10/1974 Allom et al.
4,245,505 A * 1/1981 Baynes ..... 73/296
4,573,597 A 3/1986 Adams et al.
D287,476 S * 12/1986 Craft et al. ..... D11/130.1
4,907,712 A 3/1990 Stempin
4,932,621 A 6/1990 Kowk
D331,792 S 12/1992 Wilcox
5,186,350 A * 2/1993 McBride ..... 220/739
D385,615 S 10/1997 St-Louis
5,893,547 A * 4/1999 Cohen, Jr. ..... 248/521
5,901,525 A * 5/1999 Doeringer et al. ..... 52/736.4
6,076,546 A * 6/2000 Waters ..... 137/390
6,299,124 B1 * 10/2001 Reback et al. ..... 248/519
6,508,477 B1 * 1/2003 Burkett ..... 280/47.26
6,702,244 B1 * 3/2004 Bock ..... 248/314
6,709,222 B1 * 3/2004 Inman, Jr. ..... 414/490

(Continued)

*Primary Examiner*—Amy J. Sterling
(74) *Attorney, Agent, or Firm*—McGarry Bair PC

(57) ABSTRACT

The invention comprises a ring-shaped support base comprising a first outer skirt portion supporting a second inner ring portion extending upwardly from the first outer skirt portion. The second inner ring portion is adapted to slidably engage a base ring attached to the bottom of a gas cylinder, and is provided with a chamfered lip adapted to supportably communicate with the bottom of the cylinder. The support base can be fixedly attached to the base ring through threaded fasteners extending through the second inner ring and the cylinder base ring or a plurality of detents.

19 Claims, 4 Drawing Sheets

U.S. PATENT DOCUMENTS 6,729,493 B1 * 5/2004 Chen ..... 220/630

2003/0164167 A1 * 9/2003 Van Vleet ..... 126/512

* cited by examiner

GAS CYLINDER BASE

CROSS REFERENCE TO RELATED APPLICATIONS

This application claims the benefit of U.S. provisional application Ser. No. 60/398,202, filed Jul. 24, 2002, which is incorporated herein in its entirety.

BACKGROUND OF INVENTION

1. Field of the Invention

The invention relates to support structures for gas cylinders. In one aspect, the invention relates to a ring-shaped base attached to the bottom of a gas cylinder to provide a stable base for supporting the cylinder.

2. Description of the Related Art

Conventional gas cylinders, such as propane cylinders used with campers and outdoor gas grills, are typically provided with a support ring integrally attached to the bottom of the cylinder and having a diameter smaller than the diameter of the cylinder. Consequently, such support rings are unable to provide sufficient resistance to side forces tending to overturn the cylinder during transportation or use on uneven ground.

To prevent this undesirable overturning, users often place the gas cylinder in a container, such as a cardboard box or a plastic or wire milk basket, for transportation and use. However, such containers are not designed to accommodate a gas cylinder. Preferably, the container will be large enough to accommodate the cylinder but not so large as to allow the cylinder to move about the container. Even so, the container will take up more room than necessary, and can be misplaced or damaged. Alternatively, the cylinder user can simply allow the cylinder to roll about in an automobile trunk or a pickup truck bed during transportation. However, such cylinder abuse can damage the cylinder with consequent potential failure and injury to persons or property.

Supplemental support structures for gas cylinders have been developed but are unsatisfactory because the gas cylinder extends through the support base so that the weight of the gas cylinder is supported by the underlying support surface rather than the support base, the support base is not attached to the gas cylinder and will not remain with the cylinder when the cylinder is moved, or the support mechanism renders the support base difficult to remove from the tank. Other support structures enclose the cylinder or support the cylinder on a frame comprising multiple parts, including legs. Such support structures are unwieldy, complicated to use, or comprise parts that may be damaged or lost.

SUMMARY OF INVENTION

A gas cylinder base for supporting in an upright position thereon a gas cylinder having a base ring comprising at least one base ring aperture therethrough comprises a base skirt having a first lateral dimension, and a support element extending upwardly from the base skirt, defining a second lateral dimension less than the first lateral dimension, and adapted to slidably receive the base ring of the gas cylinder, the support element comprising at least one fastener for attaching the gas cylinder base to the gas cylinder, wherein the at least one fastener is adapted to engage the base ring to attach the gas cylinder base to the gas cylinder.

In one embodiment, the diameter of the base skirt is greater than the diameter of the gas cylinder. In another embodiment, the support element further comprises at least one aperture therethrough. The aperture can be threaded, and the at least one fastener can be threaded so that the at least one fastener can be inserted into the at least one base ring aperture. The at least one fastener can be a threaded thumb screw.

In another embodiment, the support element can comprise a continuous support ring. In yet another embodiment, the support element can comprise a plurality of discontinuous lugs. In another embodiment, the base skirt is circular. The support element can be coaxial with the base skirt. In yet another embodiment, the support element comprises at least one detent.

In another embodiment, a gas cylinder support assembly comprises a gas cylinder having a base ring attached thereto comprising at least one base ring aperture therethrough, and a gas cylinder base comprising a circular base skirt having a first lateral dimension, and a support element extending upwardly from the base skirt, defining a second lateral dimension less than the first lateral dimension, and adapted to slidably receive the base ring of the gas cylinder, the support element comprising at least one fastener for attaching the gas cylinder base to the gas cylinder, wherein the at least one fastener is adapted to engage the base ring to attach the gas cylinder base to the gas cylinder.

DETAILED DESCRIPTION

Figure 1:
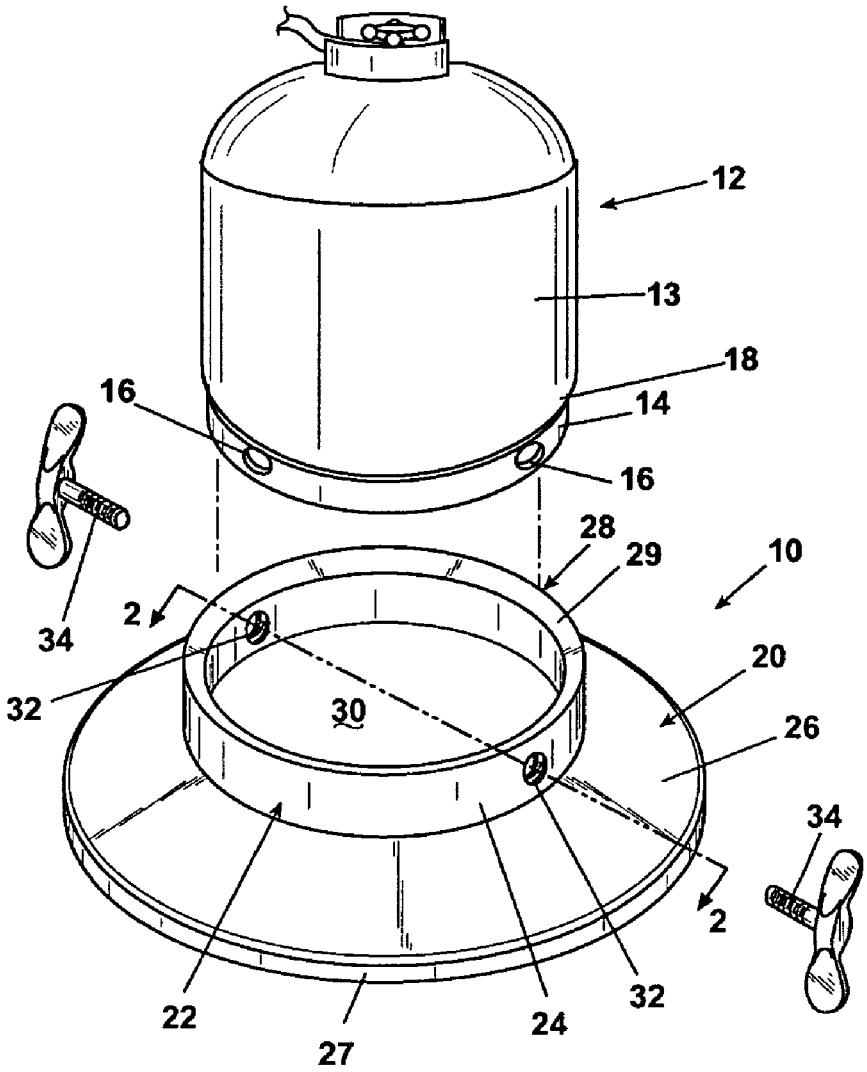
FIG. 1 is an exploded view of a gas cylinder and a first embodiment of gas cylinder base according to the invention.

The invention comprises a one-piece, circular support base which can be secured to the bottom of a gas cylinder, such as a portable propane cylinder, to support the cylinder during transportation and use, and prevent the cylinder from being inadvertently overturned. As shown in FIG. 1, a conventional portable gas cylinder 12 typically comprises a cylinder body 13 supported on a circular base ring 14. The base ring 14 is a generally ring-like annular structure formed of a thin strip of metal, such as steel, and fixedly attached to the cylinder body 13, such as by welding. The base ring 14 is typically provided with regularly-spaced circular apertures 16 extending therethrough. The lower portion of the gas cylinder body 13 is typically formed into a rounded bottom shoulder 18 where the side of the cylinder body 13 transitions into the cylinder bottom.

Figure 2:
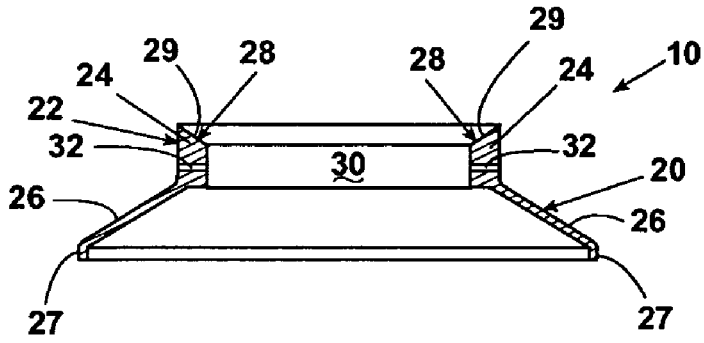
FIG. 2 is a sectional view of the gas cylinder base of FIG. 1 taken through line 2—2.

As shown in FIGS. 1 and 2, the preferred embodiment of the support base 10 comprises a circular one-piece body comprising an annular outer base skirt 20 and an inner support element, shown in FIGS. 1 and 2 as an annular support ring 22, in coaxial juxtaposition and having a circular aperture 30 coaxially extending therethrough. The outer base skirt 20 is in the general form of a truncated cone. It will be apparent to a person of ordinary skill in the relevant art that the outer base skirt can be of a non-circular shape, such as rectilinear, octagonal, triangular, and the like. The inner support ring 22 is a generally ring-like annular structure extending upwardly from the top of the outer base skirt 20 and terminating in a chamfered lip 28 having an inwardly-inclined face 29. The inner support ring 22 has a height sufficient to elevate the base ring 14 of the gas cylinder 12 above the underlying surface on which the support base 10 is supported.

The inner support ring 22 is provided with at least one threaded aperture 32 for threadably receiving a conventional threaded fastener 34, such as a thumb screw or similar threaded fastener. The design of the inner support ring 22 provides a structure of suitable strength and configuration for threading the threaded fastener 34 through the threaded aperture 32 and into the circular apertures 16 for retaining the support base 10 to the circular base ring 14 of the gas cylinder 12. In order to retain the support base 10 on the circular base ring 14 using the readily installed and removed threaded fasteners 34, the vertically-extending inner support ring 22 must be utilized.

Figure 3:
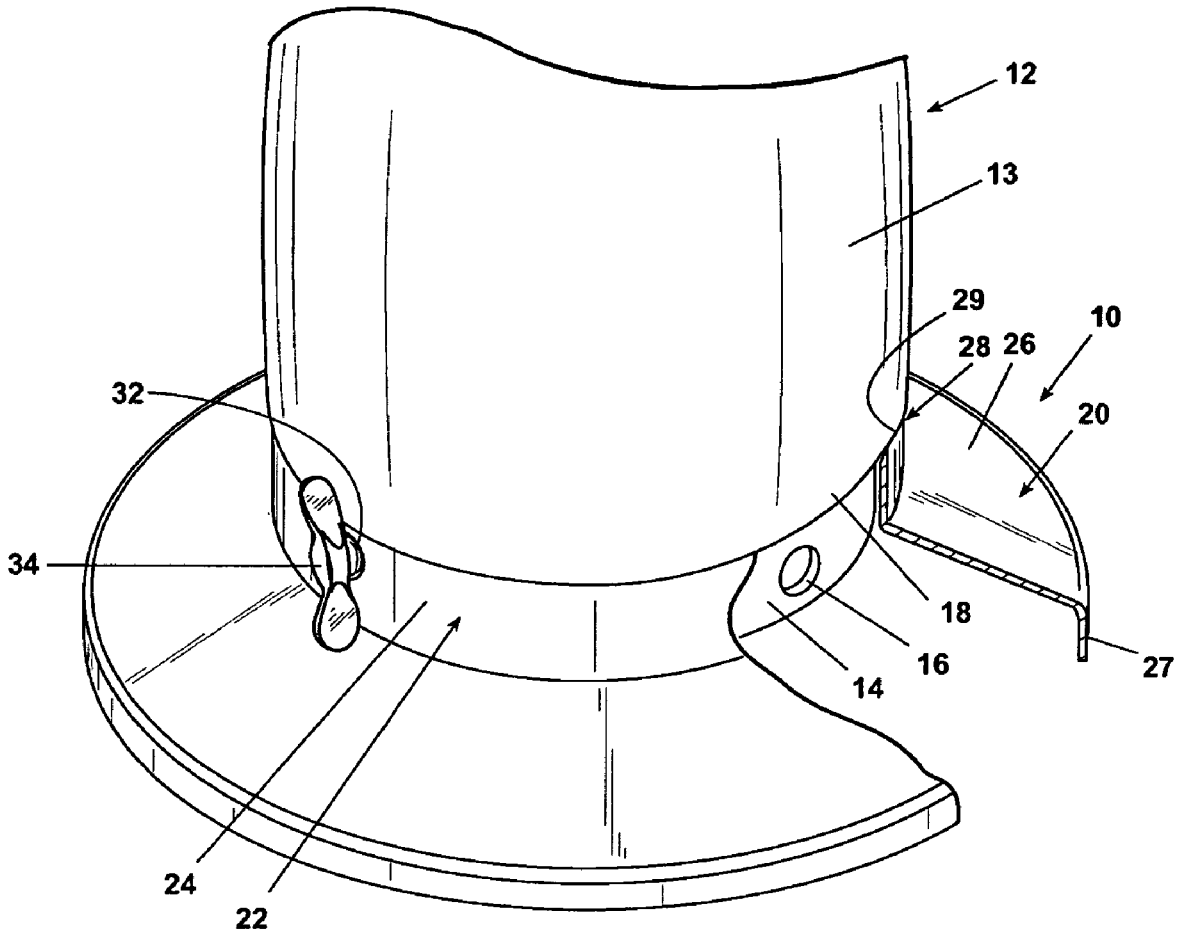
FIG. 3 is a partial cutaway view of a gas cylinder attached to the gas cylinder base of FIG. 1 according to the invention.

As shown in FIGS. 1 and 3, the inner support ring 22 is adapted to slidably receive the circular base ring 14 of a conventional portable gas cylinder 12. The chamfered lip 28 is adapted to communicate with and support the bottom shoulder 18 of the portable gas cylinder 12, and the inclined face 29 of the chamfered lip 28 seats the cylinder 12 in generally coaxial alignment with the gas cylinder base 10. At least one threaded fastener 34 is threaded through the aperture 32 into a base ring aperture 16 to hold the gas cylinder base 10 to the gas cylinder 12. Alternatively, the threaded fastener 34 can be tightened against the base ring 14 rather than through the aperture 32 to hold the gas cylinder base 10 to a gas cylinder having a base ring without apertures. This configuration will be particularly effective with diametrically-opposed fasteners, such as shown in FIG. 1. The end of the fastener 34 can also be provided with a point which will "bite" into the base ring 14 as the fastener 34 is tightened against the base ring 14. As shown in FIG. 3, when threaded fasteners 34 are used, the gas cylinder base 10 and the gas cylinder 12 form a structure possessing high lateral stability and resistance to overturning which can be easily transported as an integrated unit.

The gas cylinder base 10 is preferably fabricated of high-strength plastic in a safety red color through an injection molding process. Other materials and manufacturing processes can be utilized to fabricate the gas cylinder base 10. For example, the gas cylinder base 10 can be made of a metal, such as steel, comprising a separate inner support ring 22 and outer base skirt 20, with the inner support ring 22 welded to the outer base skirt 20 around the circumference of the inner support ring 22 at its interface with the outer base skirt 20 to form the cylinder base 10.

Figure 4:
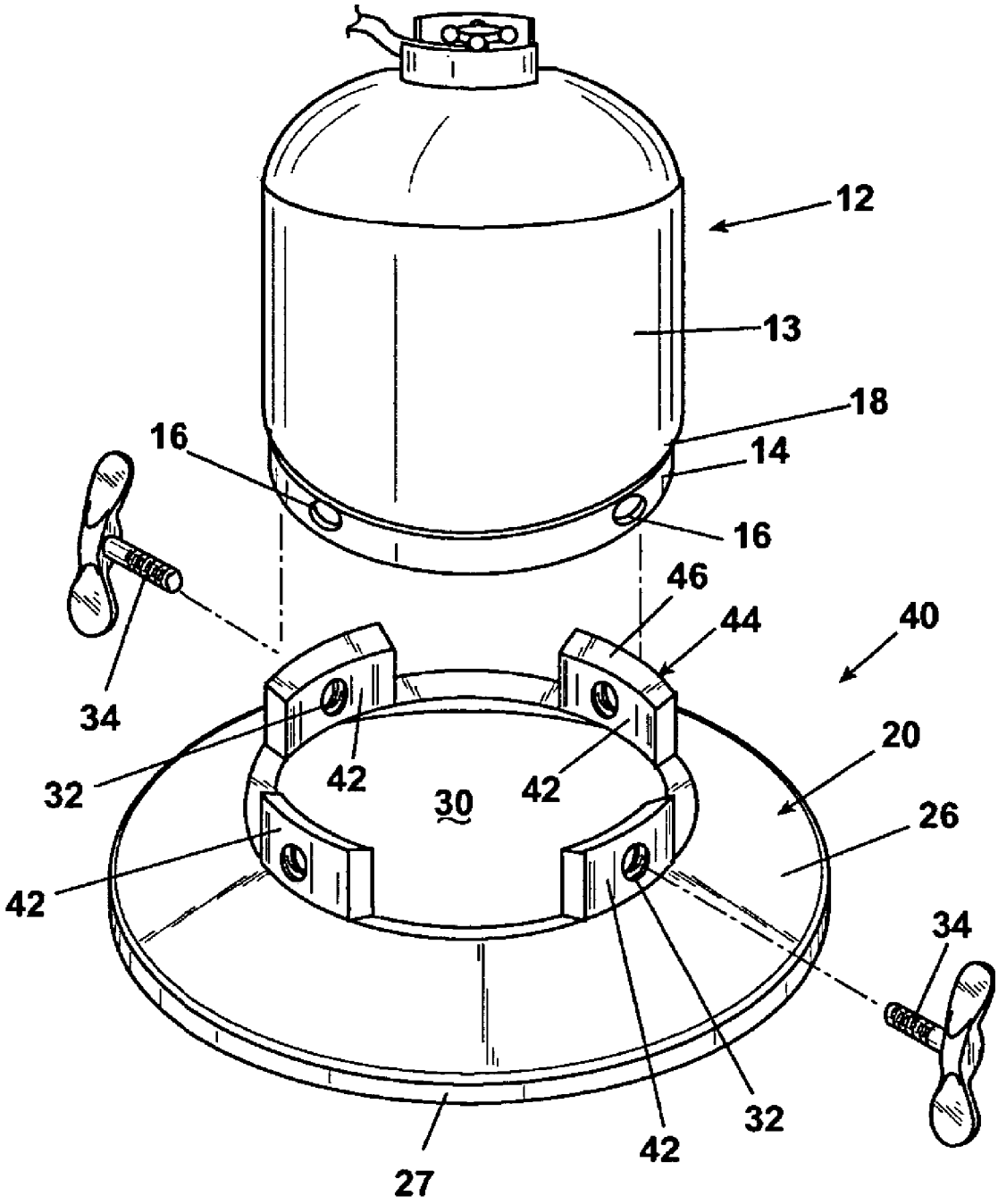
FIG. 4 is an exploded view of a gas cylinder and a second embodiment of a gas cylinder base according to the invention.

FIG. 4 illustrates a second embodiment of a gas cylinder base 40 which is similar in many respects to the first embodiment of the gas cylinder base 10 and, thus, like numerals are used to identify like elements. The gas cylinder base 40 differs from the gas cylinder base 10 in that the inner support element comprises a plurality of discontinuous lugs 42, rather than a circular support ring, in regular, spaced-apart juxtaposition around the perimeter of the opening 30, each lug 42 extending upwardly from the top of the outer base skirt 20 and terminating in a chamfered lip 44 having an inwardly-inclined face 46. The lugs 42 are preferably arcuate in shape, although the lugs 42 can have a generally rectilinear shape. The lugs 42 have a height sufficient to elevate the base ring 14 of the gas cylinder 12 above the underlying surface on which the support base 10 is supported. Each lug 42 is provided with the threaded aperture 32.

Figure 5:
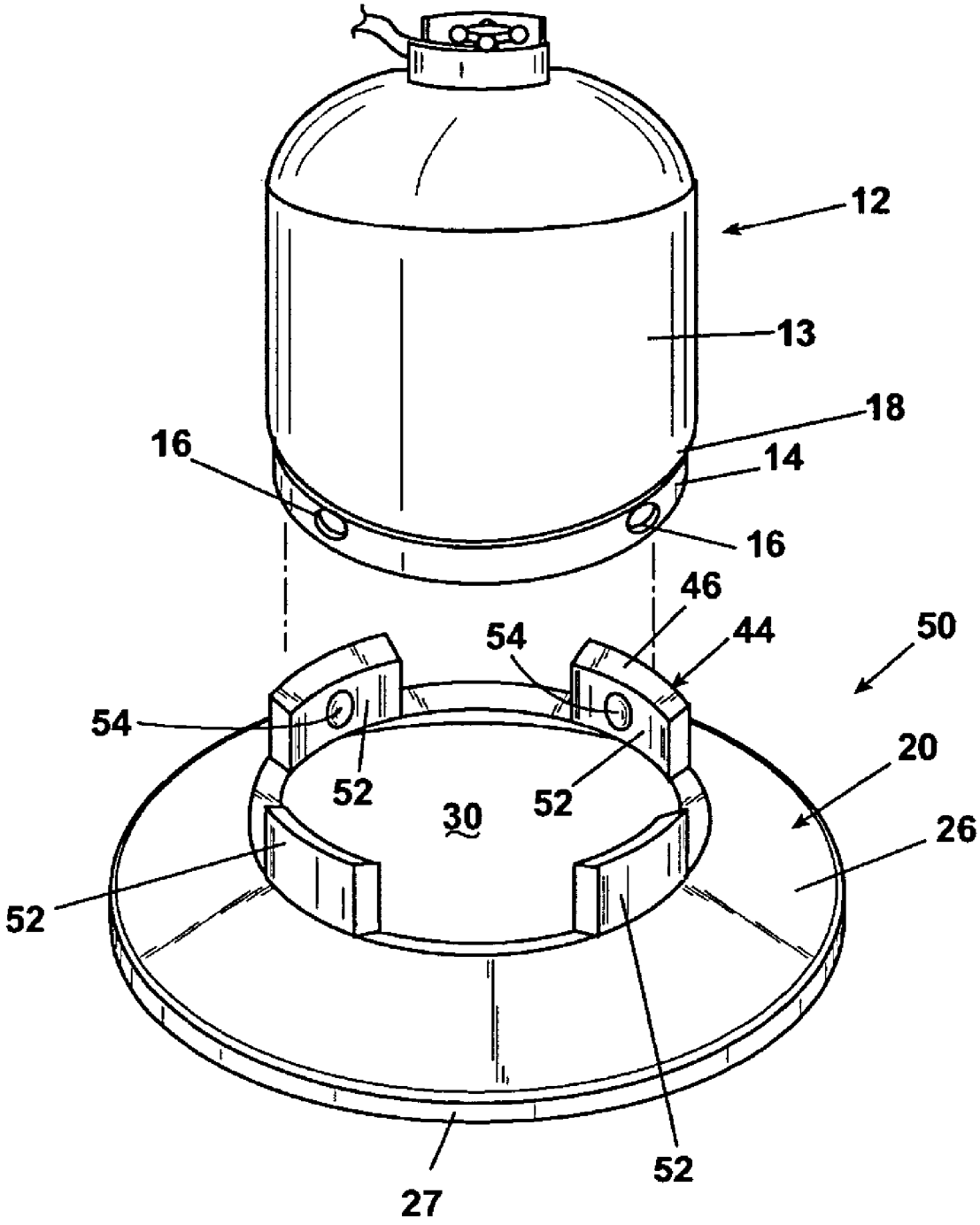
FIG. 5 is an exploded view of a gas cylinder and a third embodiment of a gas cylinder base according to the invention.

FIG. 5 illustrates a third embodiment of a gas cylinder base 50 which is similar in many respects to the second embodiment of the gas cylinder base 40 and, thus, like numerals are used to identify like elements. The gas cylinder base 50 comprises a plurality of discontinuous lugs 52 in regular, spaced-apart juxtaposition as with the gas cylinder base 40. However, the lugs 52 are provided with fasteners comprising radially-inwardly extending semi-spherical detents 54 rather than threaded apertures and fasteners. The detents 54 are adapted to engage the apertures 16 in the base ring 14 in a snap-fit communication when the base ring 14 is inserted into the inner support element. The lugs 52 can be adapted, as necessary, to resiliently deflect outwardly sufficiently to enable the detents 54 to move past the base ring 14 into the apertures 16. The gas cylinder base 50 can be removed from the gas cylinder 12 by holding the annular outer base skirt 20 of the gas cylinder base 50, such as by partially standing on it, while pulling the gas cylinder 12 away from the gas cylinder base 50. It will be readily apparent to a person skilled in the art that the detents 54 can alternatively be regularly-spaced about a continuous circular support ring rather than lugs.

The novel gas cylinder base disclosed herein is a low-cost, simple, readily-fabricated device for safely supporting a portable gas cylinder during transportation and use. The gas cylinder base will prevent a portable gas cylinder from overturning while being transported, and will also provide a stable base for supporting a portable gas cylinder on uneven ground. The support provided by the gas cylinder base prevents the gas cylinder from impacts during unrestrained transportation that can cause punctures, valve damage, loss of gas, fires, and other unsafe conditions. The cylinder base ring is elevated above the underlying support surface so that the gas cylinder is fully supported on the gas cylinder base, thus ensuring stable support for the gas cylinder, even on uneven ground. Attachment of the cylinder base to a gas cylinder using threaded connectors or detents ensures that the cylinder base remains with the gas cylinder when the gas cylinder is moved, preventing inadvertent separation and misplacement of the cylinder base and the need to separately remove and reposition the cylinder base beneath the gas cylinder. The gas cylinder base can be easily attached to a portable gas cylinder and detached when the cylinder is no longer used using the threaded fastener or detent assemblies disclosed herein. With the cylinder base supporting a gas cylinder as described herein, a conventional motor vehicle seat belt can be secured around the cylinder base where the inner support ring intersects the outer base skirt so that the gas cylinder can be safely transported on the seat of a motor vehicle.

While the invention has been specifically described in connection with certain specific embodiments thereof, it is to be understood that this is by way of illustration and not of limitation. Reasonable variation and modification are possible within the scope of the foregoing description and drawings without departing from the spirit of the invention.

The invention claimed is:

1. A gas cylinder support assembly comprising:

a gas cylinder having a base ring attached thereto comprising at least one threaded base ring aperture therethrough; and a gas cylinder base comprising:

a base skirt having a first lateral dimension; and a support element extending upwardly from the base skirt, defining a second lateral dimension less than the first lateral dimension, and adapted to slidably receive the base ring of the gas cylinder, the support element comprising at least one threaded aperture therethrough and at least one threaded fastener for attaching the gas cylinder base to the gas cylinder;

wherein the at least one fastener is adapted to engage the base ring to attach the gas cylinder base to the gas cylinder and the at least one fastener is threadably inserted into the at least one aperture.

2. A gas cylinder support assembly comprising:

a gas cylinder having a base ring attached thereto comprising at least one base ring aperture therethrough; and a gas cylinder base comprising:

a base skirt having a first lateral dimension; and a support element comprising a continuous support ring extending upwardly from the base skirt, terminating along an inner edge in a radially-inwardly sloping chamfered end, defining a second lateral dimension less than the first lateral dimension, and adapted to slidably receive the base ring of the gas cylinder;

the support element comprising at least one fastener adapted to engage the base ring for attaching the gas cylinder base to the gas cylinder.

3. A gas cylinder support assembly comprising:

a gas cylinder having a base ring attached thereto comprising at least one threaded base ring aperture therethrough; and a gas cylinder base comprising:

a circular base skirt having a first lateral dimension; and a support element coaxial with and extending upwardly from the base skirt, defining a second lateral dimension less than the first lateral dimension, and adapted to slidably receive the base ring of the gas cylinder, the support element comprising at least one threaded aperture therethrough and at least one threaded fastener for attaching the gas cylinder base to the gas cylinder;

wherein the at least one fastener is adapted to engage the base ring to attach the gas cylinder base to the gas cylinder and the at least one fastener is threadably inserted into the at least one aperture.

4. The gas cylinder support assembly of claim 2 wherein the first lateral dimension is greater than the diameter of the gas cylinder.

5. The gas cylinder support assembly of claim 2 wherein the support element further comprises at least one aperture therethrough.

6. The gas cylinder support assembly of claim 5 wherein the at least one aperture is threaded.

7. The gas cylinder support assembly of claim 6 wherein the at least one fastener is threaded.

8. The gas cylinder support assembly of claim 7 wherein the fastener is a thumb screw.

9. The gas cylinder support assembly of claim 7 wherein the at least one fastener is threadably inserted into the at least one aperture.

10. The gas cylinder support assembly of claim 7 wherein the at least one fastener is provided with a point at an end thereof for engaging the base ring.

11. The gas cylinder support assembly of claim 9 wherein the at least one fastener is insertable into at least one base ring aperture.

12. The gas cylinder support assembly of claim 3 wherein the support element comprises a continuous support ring.

13. The gas cylinder support assembly of claim 12 wherein the support ring terminates along an inner edge in a radially-inwardly sloping chamfered end.

14. The gas cylinder support assembly of claim 2 wherein the base skirt is circular.

15. The gas cylinder support assembly of claim 2 wherein the support element is coaxial with the base skirt.

16. The gas cylinder support assembly of claim 1 wherein the diameter of the base skirt is greater than the diameter of the gas cylinder.

17. The gas cylinder support assembly of claim 1 wherein the fastener is a thumb screw.

18. The gas cylinder support assembly of claim 1 wherein the at least one fastener is provided with a point at an end thereof for engaging the base ring.

19. The gas cylinder support assembly of claim 18 wherein the at least one fastener is inserted into the at least one base ring aperture.

* * * * *